United States Patent [19]

Ajioka et al.

[11] 4,435,715

[45] Mar. 6, 1984

[54] ROD-EXCITED WAVEGUIDE SLOT ANTENNA

[75] Inventors: James S. Ajioka, Fullerton; Dick M. Joe, Anaheim, both of Calif.

[73] Assignee: Hughes Aircraft Company, El Segundo, Calif.

[21] Appl. No.: 191,880

[22] Filed: Sep. 29, 1980

[51] Int. Cl.[3] ..... H01Q 13/18

[52] U.S. Cl. ..... 343/771

[58] Field of Search ..... 343/768, 770, 771

[56] References Cited

U.S. PATENT DOCUMENTS

| | | | |
|---|---|---|---|
| 2,574,433 | 11/1951 | Clapp | 343/771 |
| 2,597,144 | 5/1952 | Clapp | 343/771 |
| 3,004,259 | 10/1961 | Shanks et al. | 343/768 |
| 3,176,300 | 3/1965 | Kuecken | 343/767 |
| 3,183,511 | 5/1965 | Ajioka | 343/767 |
| 3,382,501 | 5/1968 | Fee | 343/767 |
| 4,303,923 | 12/1981 | Bitter et al. | 343/771 |

OTHER PUBLICATIONS

Roger E. Clapp, *Probe-Fed Slots as Radiating Elements in Linear Arrays,* Jan. 25, 1944, Radiation Laboratory Report No. 455, pp. 455-8 through 455-16.

Robert S. Elliott, *Antenna Theory and Design,* 1981, Prentice-Hall, pp. 88-90.

*Primary Examiner*—Eli Lieberman

*Attorney, Agent, or Firm*—Thomas A. Runk; L. V. Link, Jr.; A. W. Karambelas

[57] ABSTRACT

A power-radiating slotted waveguide comprises one or more rods mounted inside the waveguide adjacent a non-inclined slot. The rod causes power to be radiated and because the slot is non-inclined, undesirable cross-polarized radiation is minimized. The energy radiated from the slot can be varied by varying the area between the rod and the waveguide walls.

3 Claims, 7 Drawing Figures

ROD-EXCITED WAVEGUIDE SLOT ANTENNA

TECHNICAL FIELD

This invention relates generally to low-sidelobe, low cross-polarization antennas and more particularly to narrow-wall waveguide slot arrays.

BACKGROUND OF THE INVENTION

1. Field of the Invention

A narrow wall waveguide slot array is an antenna system that uses slotted waveguides to radiate energy. This invention is an improvement in the field of slotted waveguides.

2. Description of the Prior Art

Conventional slotted waveguides have utilized "inclined" rectangular slots in the narrow wall of a waveguide to radiate electromagnetic energy. The longer edges of the slot were not orthogonal to the axis of the waveguide, but were inclined from right angles to a greater or lesser degree. The inclined edges of the slot distorted the RF current in the wall containing the slot, and caused an electric field across the slot. The electric field induced across the slot radiated energy into space.

Inclined waveguide slots can cause a serious problem: they radiate a large amount of cross-polarized radiation. This cross-polarization does not contribute to main beam gain and is totally lost in radiated lobes in other directions. Systems utilizing inclined-slot waveguide arrays can be undesirable because the cross-polarized lobes contribute to ground clutter and increase vulnerability to radiation-sensitive missiles.

Cross-polarization suppressing baffles have been used to suppress the undesirable lobes caused by inclined slots. However, such baffles introduce considerable weight and cost in large arrays.

Another prior art approach has been to utilize "non-inclined" slots with waveguide irises located inside the waveguide and adjacent to each slot. Non-inclined slots normally do not radiate energy, but the pressure of an iris adjacent to the slot induces an electric field across the non-inclined slot, resulting in a controlled amount of radiation. This solution, however, has suffered from two problems. The cost of installing the irises has been prohibitive for large arrays of slots. Further, the capacitive portion of the iris must be relatively deep to obtain a sufficiently large excitation for efficient arrays. But the deep capacitive portion of the iris reduces the high power handling capability of an array due to arcing from the iris edges.

Therefore, a major problem in this field has been the elimination of undesirable cross-polarized lobes without simultaneously increasing significantly the weight or cost of the system.

SUMMARY OF THE INVENTION

The present invention solves the afore-mentioned problems of the prior art by using a non-inclined slot and a particular structure inside the waveguide near the slot to cause radiation. Radiation from the slot is caused by one or more electrically conductive rods. Each rod is disposed inside the waveguide near the slot, and both ends of each rod contact the walls of the waveguide. One end of each rod is joined to the waveguide wall at a point adjacent to the longer edge of the slot. The other end of each rod is joined to the waveguide wall at a point that is not adjacent to the slot. The energy radiated from the slotted waveguide can be varied by varying the area between each rod and the waveguide walls.

Accordingly, one purpose of this invention is to provide an improved slotted waveguide antenna.

It is also a purpose of this invention to provide a slotted waveguide that radiates energy without cross-polarized components.

Another purpose of this invention is to provide an inexpensive, easily installed structure that will cause a non-inclined waveguide slot to radiate energy, with the amount of radiation controllable over a wide range of values that remain substantially constant over a wide frequency band.

DETAILED DESCRIPTION OF THE INVENTION

Figure 1:
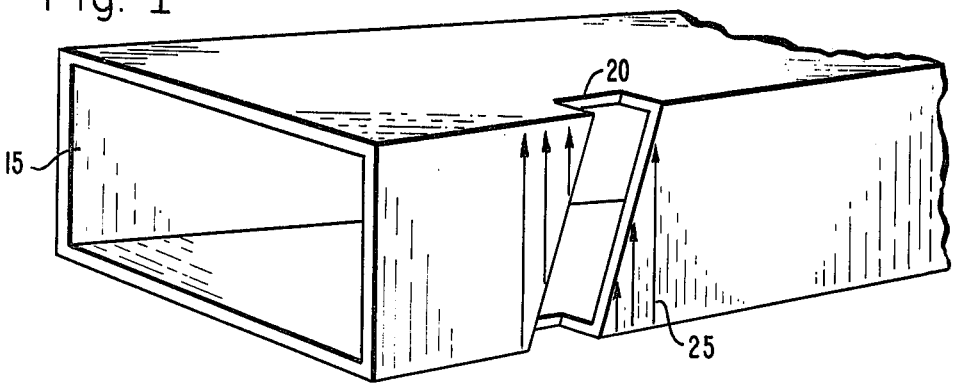
FIG. 1 is a perspective view of a prior art device utilizing an inclined slot.

FIG. 1 illustrates the prior art practice of stimulating radiation from a slotted rectangular waveguide. Waveguide 15 has a rectangular slot 20 in a narrow wall of the waveguide. The slot's edges are inclined with respect to the edges of the narrow wall, meaning that their relation is neither parallel nor perpendicular to the edges. The inclined slot 20 interrupts the RF current 25 flowing through the narrow wall containing the slot. The interruption of current 25 induces an electric field across the slot, resulting in the radiation of energy outwardly from the slot 20 in a direction normal to the plane of the narrow waveguide wall. However, the radiated energy includes cross-polarized radiation which is undesirable for reasons explained earlier. This undesirable radiation is due to the geometrical configuration of the inclined slot.

Figure 2:
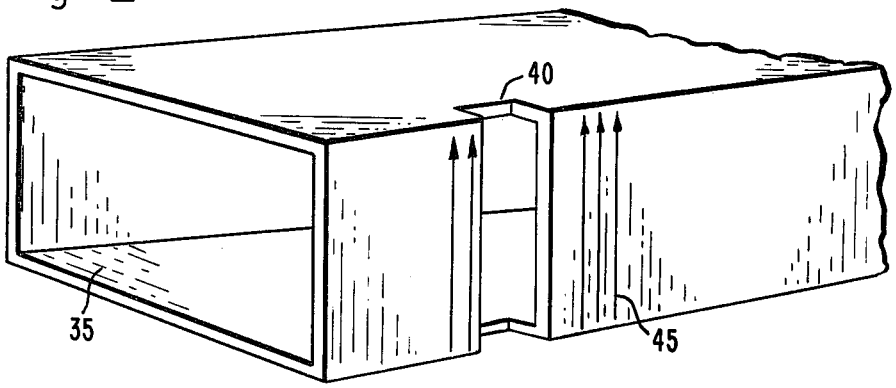
FIG. 2 is a perspective view of a non-radiating non-inclined slotted waveguide.

FIG. 2 shows a waveguide 35 with a non-inclined slot 40 in one of the narrow walls thereof. Because the slot 40 is not inclined, it will not interrupt RF current 45 flowing in the direction indicated through the slotted wall. Therefore, the uninclined slot will not radiate energy.

In the past, waveguide irises (not shown) have been installed in the slotted waveguide 35 near the slot 40. These irises stimulated radiation without cross-polarized components, but are undesirable because of cost and difficulty of installation.

Figure 3:
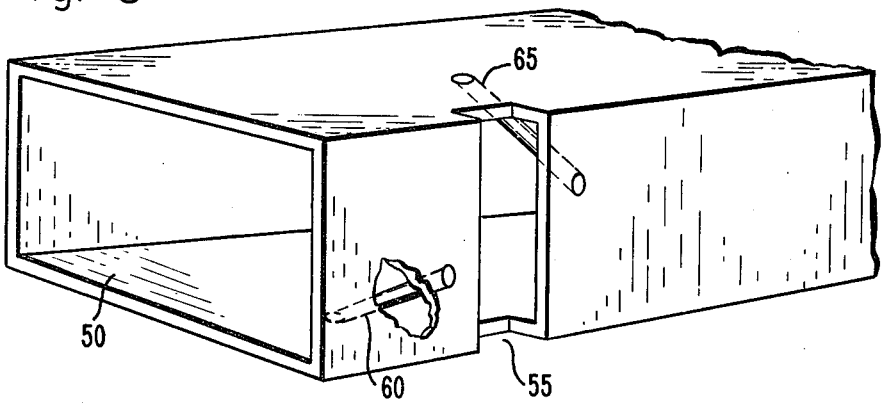
FIG. 3 is a perspective view of a particular device utilizing the present invention.

FIG. 3 shows a particular device according to the present invention that solves most of the afore-mentioned problems. The waveguide 50 contains a non-inclined slot 55 in one of the narrow waveguide walls. Although the slot 55 extends partially into the broad walls of waveguide 50, this feature is not necessary to the operation of the invention. The slot 55 may be contained wholly within a narrow wall. The waveguide 50 also comprises two rods 60 and 65 disposed as shown inside the waveguide near the the slot 55. One end of each rod is joined to the narrow waveguide wall adjacent slot 55. The other end of rod 60 is joined to the bottom waveguide wall, at point 61 and the other end of the rod 65 is joined to the top waveguide wall at point 66. Both rods 60 and 65 can be dip-soldered to the waveguide 50 at one time and are preferably made of aluminum. The aluminum waveguide is plated with tin or nickel in the areas where the rods are attached to the waveguide wall, so that the rods can be soldered to the wall.

RF current is induced in the rods 60 and 65 by the electromagnetic field in the waveguide. These currents excite an electric field across the slot in the same manner that a two-wire transmission line would do so. The rods 60 and 65 can actually be considered as a two-wire transmission line feeding the slot. The energy radiated from the slot will have no undesirable cross-polarization because the slot is not inclined.

Figure 4A:
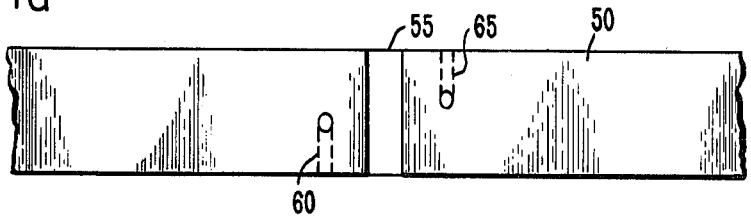
FIG. 4*a* is a side view of the narrow slotted wall of the device shown in FIG. 3.
Figure 4B:
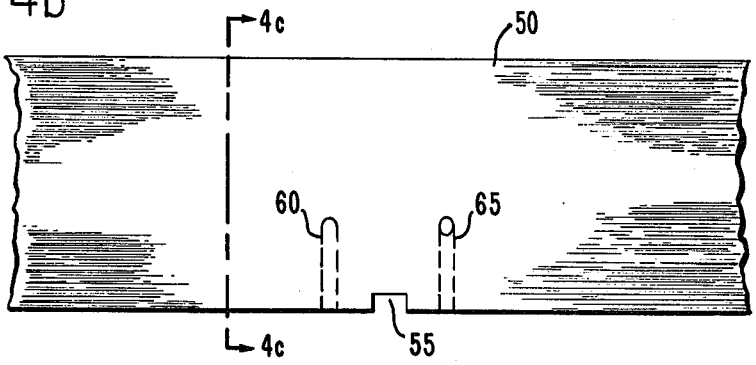
FIG. 4*b* is a top view of the device shown in FIG. 3.
Figure 4C:
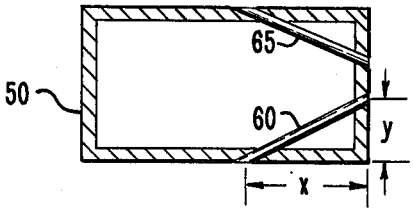
FIG. 4*c* is a sectional view taken along line A—A of FIG. 4*b*.

FIGS. 4*a–c* show in more detail the orientation of rods 60 and 65 in one embodiment of the invention. According to this embodiment, an infinite variety of rod orientations is possible. Depending upon the application, a single rod, or more than two rods may be utilized. The rods may be curved or angled, and the rods' cross-section can be circular, triangular, square, or various other shapes. Both the waveguide and the rods can be made of aluminum or another suitable material.

Figure 5:
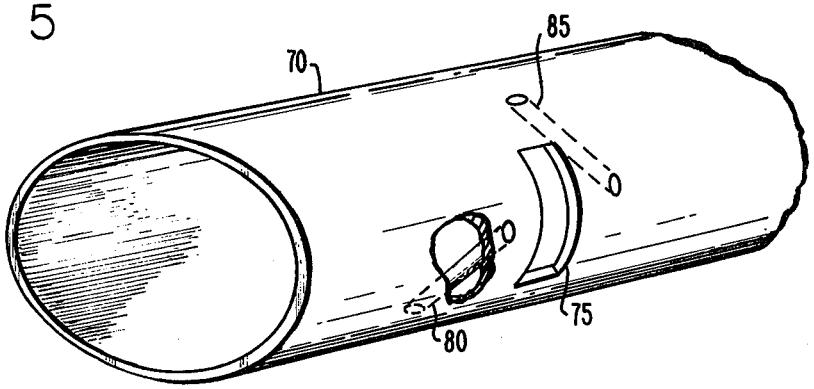
FIG. 5 is a perspective view of an alternative embodiment of the invention which employs a cylindrical waveguide configuration.

FIG. 5 illustrates another embodiment of this invention. The elliptical waveguide 70 contains a non-inclined curved slot 75 cut in its wall. Being cylindrical in shape, there is an imaginary generatrix associated with the waveguide 70. The longer edges of slot 75 are orthogonal to this generatrix. The rods 80 and 85 are mounted inside the waveguide, and one end of each of rods 80 and 85 is joined to the waveguide wall at a point adjacent the slot 75. The other end of each rod joins the waveguide 70 at a point away from the slot 75. The electromagnetic wave in the waveguide will induce current in the rods 80 and 85, which act as a two-wire transmission line that feeds the slot 75, causing an electric field across the slot 75. This electric field radiates energy into space without undesirable cross-polarized components.

Accurately controlling the amount of power radiated from a slot is important to obtaining the desired radiation pattern and high antenna efficiency. The power radiated from the slotted waveguide can be increased by increasing the area between one or more rods and the walls of the waveguide, or decreased by decreasing that area. As an example, in FIG. 4*c* power radiated from the slotted waveguide 50 could be increased or decreased by respectively increasing or decreasing either the dimension "x" of the rod 60, or the dimension "y," or both. An increase or decrease of either dimension would respectively increase or decrease the area between the rod 60 and the walls of the waveguide 50. The area between a rod and the waveguide walls could be increased by bending the rod away from the walls, or decreased by bending the rod toward the walls. The resulting increase or decrease of area would respectively increase or decrease the power radiated from the slotted waveguide.

The above-described embodiments merely illustrate some of the many possible specific embodiments that represent applications of the principles of the present invention. Various other arrangements can be readily devised in accordance with these principles by those skilled in this art without departing from the spirit and scope of the invention.

What is claimed is:

1. In a power-radiating slotted waveguide having a rectangular waveguide which has first and second broad walls and first and second narrow walls, the first one of said narrow walls having a substantially non-inclined slot formed therein, the improvement comprising:

(a) a first substantially linear conducting rod having one end rigidly connected to said first narrow wall adjacent to one long edge of said slot and having the second end rigidly connected to the first broad wall; and (b) a second substantially linear conducting rod having one end rigidly connected to said first narrow wall adjacent to the opposite long edge of said slot as said first rod and having the second end rigidly connected to the second broad wall.

2. The power-radiating slotted waveguide of claim 1 wherein said substantially non-inclined slot formed in said first narrow wall extends into said first broad wall.

3. The power-radiating slotted waveguide of claim 1 wherein said substantially non-inclined slot formed in said first narrow wall extends into said second broad wall.

* * * * *